US008029419B2

(12) United States Patent
Wan

(10) Patent No.: US 8,029,419 B2
(45) Date of Patent: Oct. 4, 2011

(54) SUPPORT MECHANISM FOR TRANSFORMING BICYCLE INTO STATIONARY BIKE

(76) Inventor: Kuo Hui Wan, Hsinchu (TW)

( * ) Notice: Subject to any disclaimer, the term of this patent is extended or adjusted under 35 U.S.C. 154(b) by 0 days.

(21) Appl. No.: 12/785,543

(22) Filed: May 24, 2010

(65) Prior Publication Data

US 2010/0234188 A1 Sep. 16, 2010

Related U.S. Application Data

(63) Continuation-in-part of application No. 11/412,798, filed on Apr. 28, 2006, now Pat. No. 7,883,449.

(51) Int. Cl.
*A63B 69/16* (2006.01)

(52) U.S. Cl. ..... 482/61; 601/36

(58) Field of Classification Search ..... 482/51, 482/54, 57, 58, 59, 60, 61, 148; 601/34, 601/35, 36; 434/61, 247, 255
See application file for complete search history.

(56) References Cited

U.S. PATENT DOCUMENTS

| | | | | |
|---|---|---|---|---|
| 4,082,265 | A * | 4/1978 | Berkes | 482/61 |
| 4,415,152 | A * | 11/1983 | Smith | 482/61 |
| 4,580,983 | A * | 4/1986 | Cassini et al. | 482/61 |
| 4,932,651 | A * | 6/1990 | Defaux | 482/61 |
| 7,520,842 | B2 * | 4/2009 | Comair et al. | 482/61 |
| 7,883,449 | B2 * | 2/2011 | Wan | 482/57 |
| 2005/0209064 | A1 * | 9/2005 | Peterson et al. | 482/61 |

* cited by examiner

*Primary Examiner* — Loan Thanh
*Assistant Examiner* — Tam Nguyen

(57) ABSTRACT

A support mechanism includes a front unit and a rear unit, wherein two swing members are respectively and pivotably connected to the front unit and the rear unit. Two positioning members are respectively connected to the two swing members and the front wheel shaft and the rear wheel shaft of a bicycle are connected to the two positioning members, so that the bicycle can pivot together with the swing members. Multiple rollers respectively connected to the front unit and the rear unit and the front and rear wheels are rotatably in contact with the rollers. A connection unit is connected between the rollers on the front unit and the rear unit. When treading the pedals of the bicycle, the front and rear wheels are rotated and the front wheel can be pivoted and the bicycle can be swung.

6 Claims, 6 Drawing Sheets

SUPPORT MECHANISM FOR TRANSFORMING BICYCLE INTO STATIONARY BIKE

This is a Continuation-In-Part application of the applicant's former patent application Ser. No. 11/412,798, filed on Apr. 28, 2006, the present invention relates to a support mechanism, and more particularly, to a support mechanism for supporting two wheels of the bicycle so as to transform the bicycle into a stationary bike.

FIELD OF THE INVENTION

Background of the Invention

A conventional exerciser such as a stationary bike 10 as shown in FIG. 1 generally includes a frame connected on a base 110 and the frame includes a seat 102 on the seat post and a handle 104 connected to the front portion of the frame. A wheel 108 is connected to the front portion of the frame and can be driven by operation of two pedals 106 such that the user can sit on the seat 102 and tread the pedals 106 to rotate the wheel 108 to achieve the exercising purpose. However, the stationary bike 10 has only one function and is bulky so that it cannot satisfy the users. Besides, the handle 104 is fixed and cannot be pivot and the users cannot enjoy the way as riding real bicycles.

FIG. 2 shows a support member 27 which is connected to the bicycle frame by two links 26 and supports the shaft of the rear wheel 22 of the bicycle, so that the rear wheel 22 is freely rotated when treading the pedals. The front wheel 21 can be pivoted by operation of the handle 23 of the bicycle so that the user can operate the handle 23 while treading the pedals and the bicycle is used as a stationary bike. Nevertheless, because the support member 27 is rested on the floor so that the bicycle cannot be swung during operation. Besides, the front wheel 21 cannot be rotated. These also restrict the users to enjoy the feeling as riding a real bicycle.

The present invention intends to provide a support mechanism for transforming a bicycle into a stationary bike, wherein the bicycle is supported by the support mechanism and is operated as the operation to a real bicycle.

SUMMARY OF THE INVENTION

The present invention relates to a support mechanism and comprises a front unit and a rear unit. Two swing members are respectively and pivotably connected to the front unit and the rear unit. Two positioning members are respectively connected to the two swing members. A roller set includes multiple rollers which are respectively connected to the front unit and the rear unit. Each roller includes two protrusions extending from two ends thereof. A connection unit includes an outer tube, an inner tube rotatably extending through the outer tube, and two connection ends. The two connection ends are connected to two protrusions of two respectively rollers which are respectively located on the front unit and the rear unit.

When the rear wheel is rotated by treading the pedals of the bicycle, the rollers on the rear unit are rotated by the rotation of the rear wheel and the roller on the front unit are rotated by the connection unit, so that the front wheel of the bicycle is rotated.

The primary object of the present invention is to provide a support mechanism for transforming the bicycle into a stationary bike.

Another object of the present invention is to provide a support mechanism for transforming the bicycle into a stationary bike, wherein both of the front wheel and the rear wheel of the bicycle can be rotated.

Yet another object of the present invention is to provide a support mechanism for transforming the bicycle into a stationary bike, wherein the bicycle can be swung during operation.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
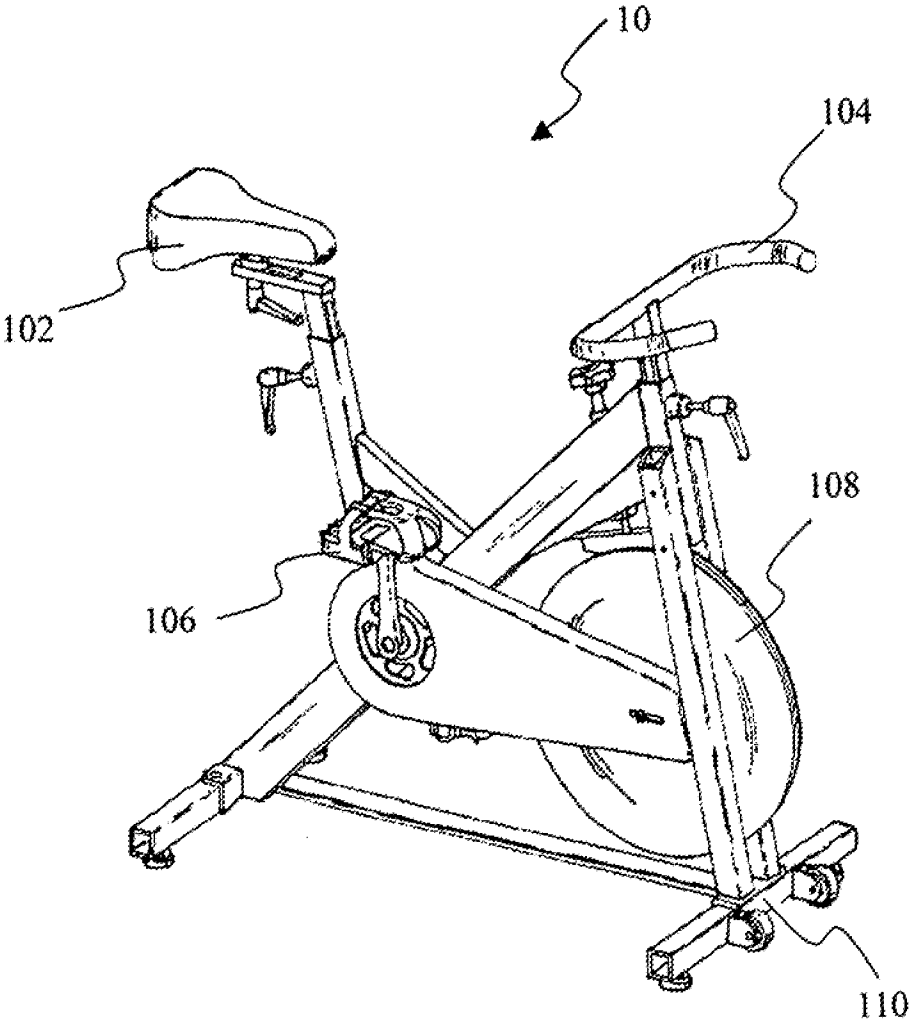
FIG.1 Prior Art
FIG. 1 shows a conventional stationary bike.
Figure 2:
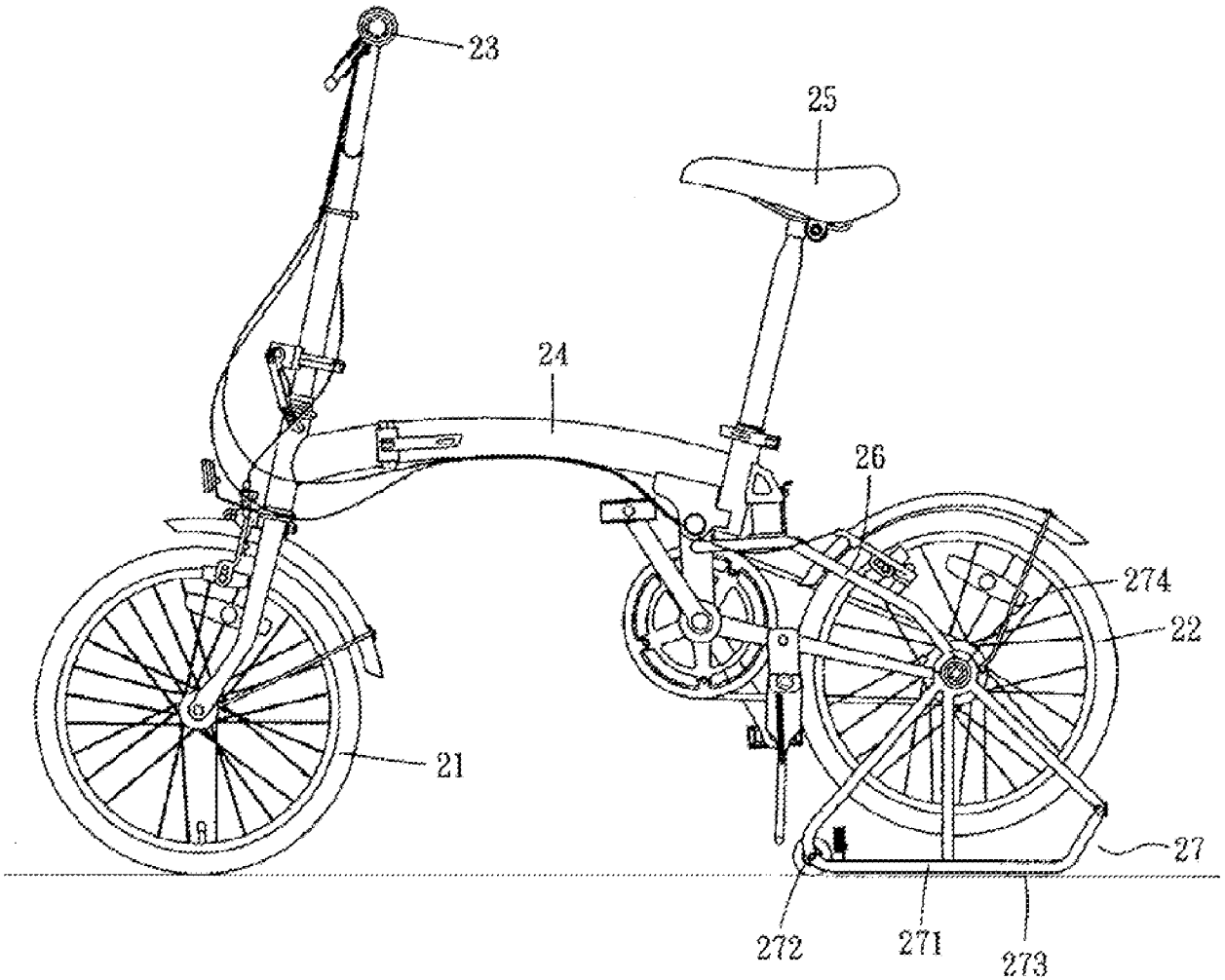
FIG.2 Prior Art
FIG. 2 shows a connectional support member for transforming a bicycle into a stationary bike.
Figure 3:
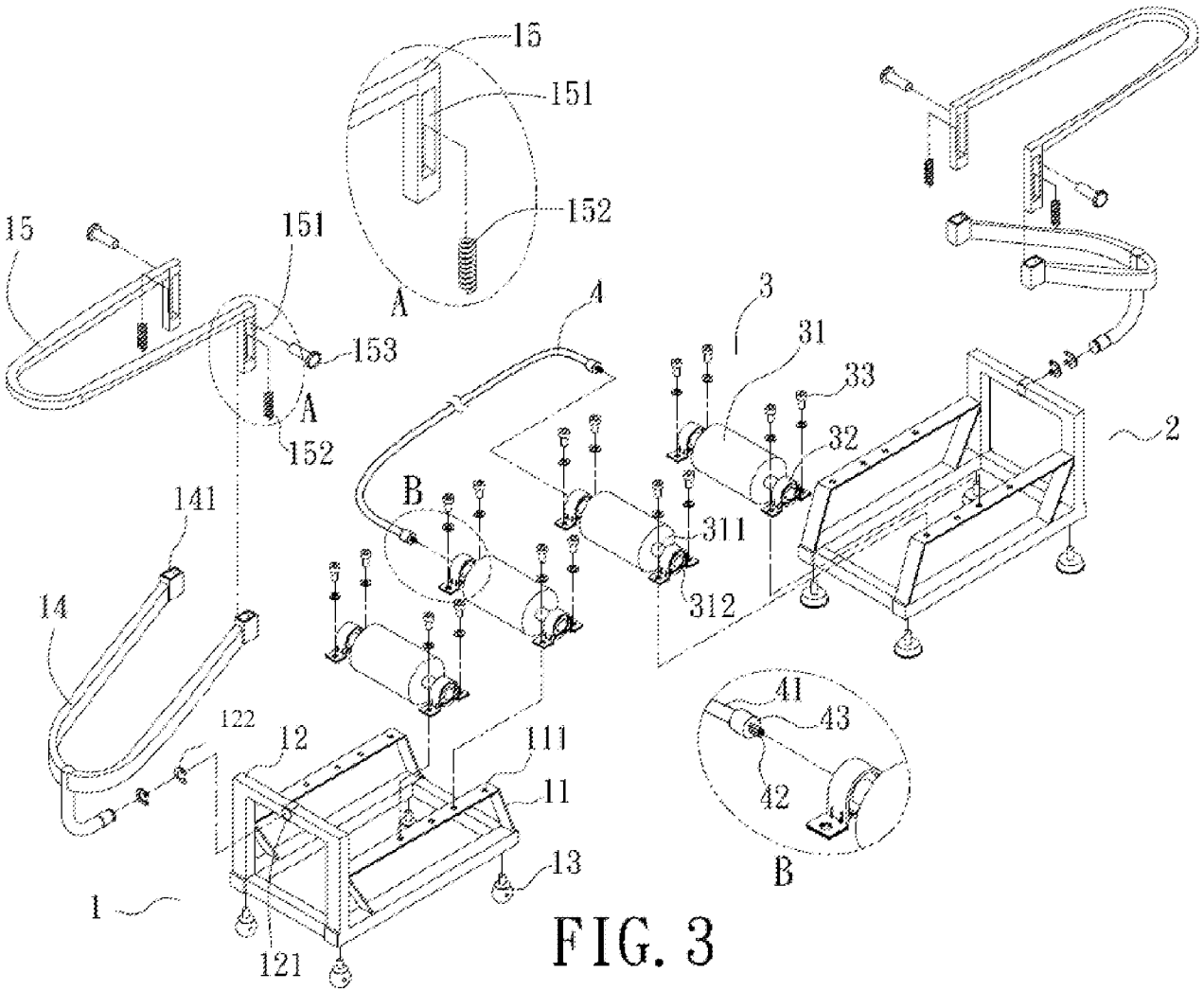
FIG. 3 is an exploded view to show the support mechanism of the present invention.
Figure 4:
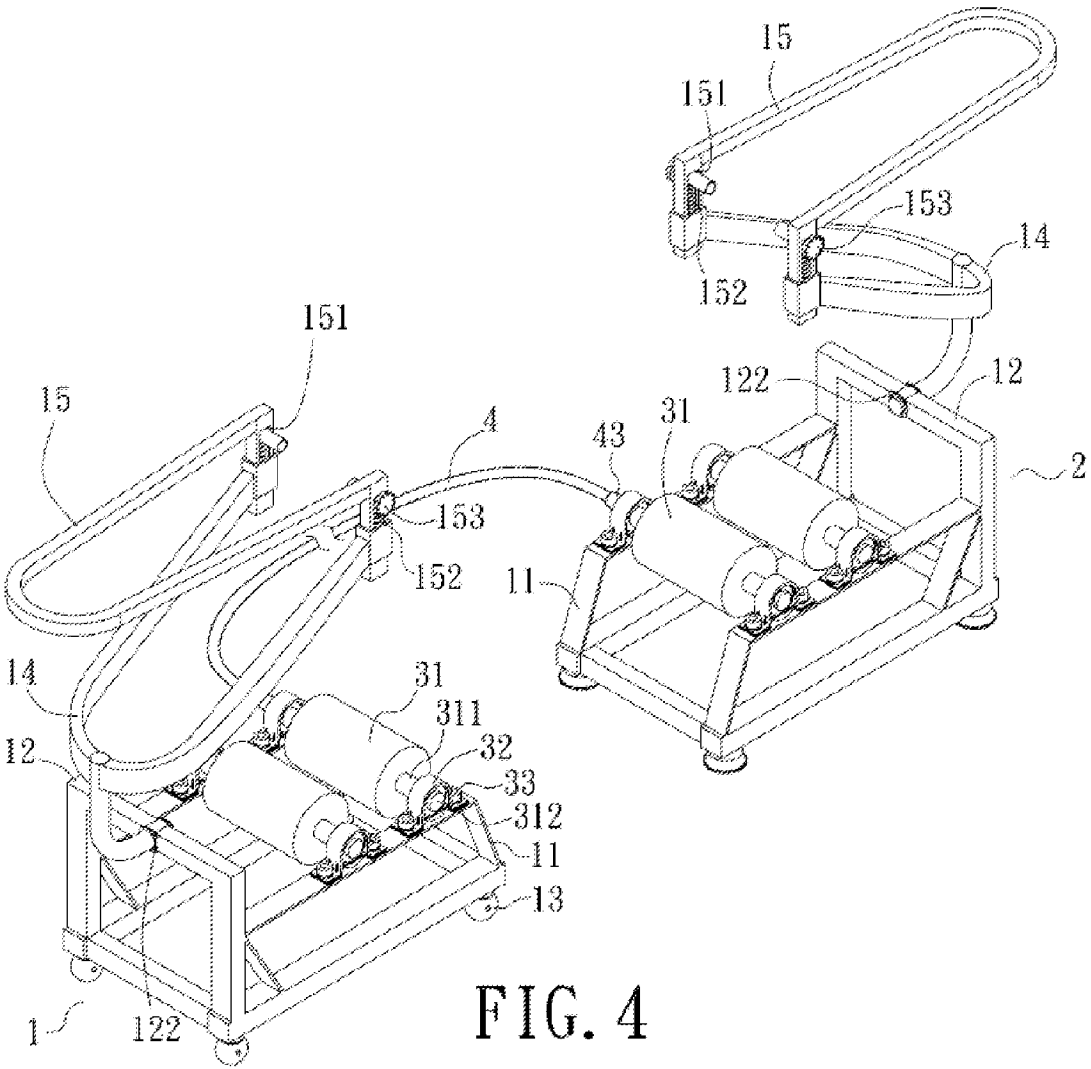
FIG. 4 is a perspective view to show the support mechanism of the present invention.
Figure 5:
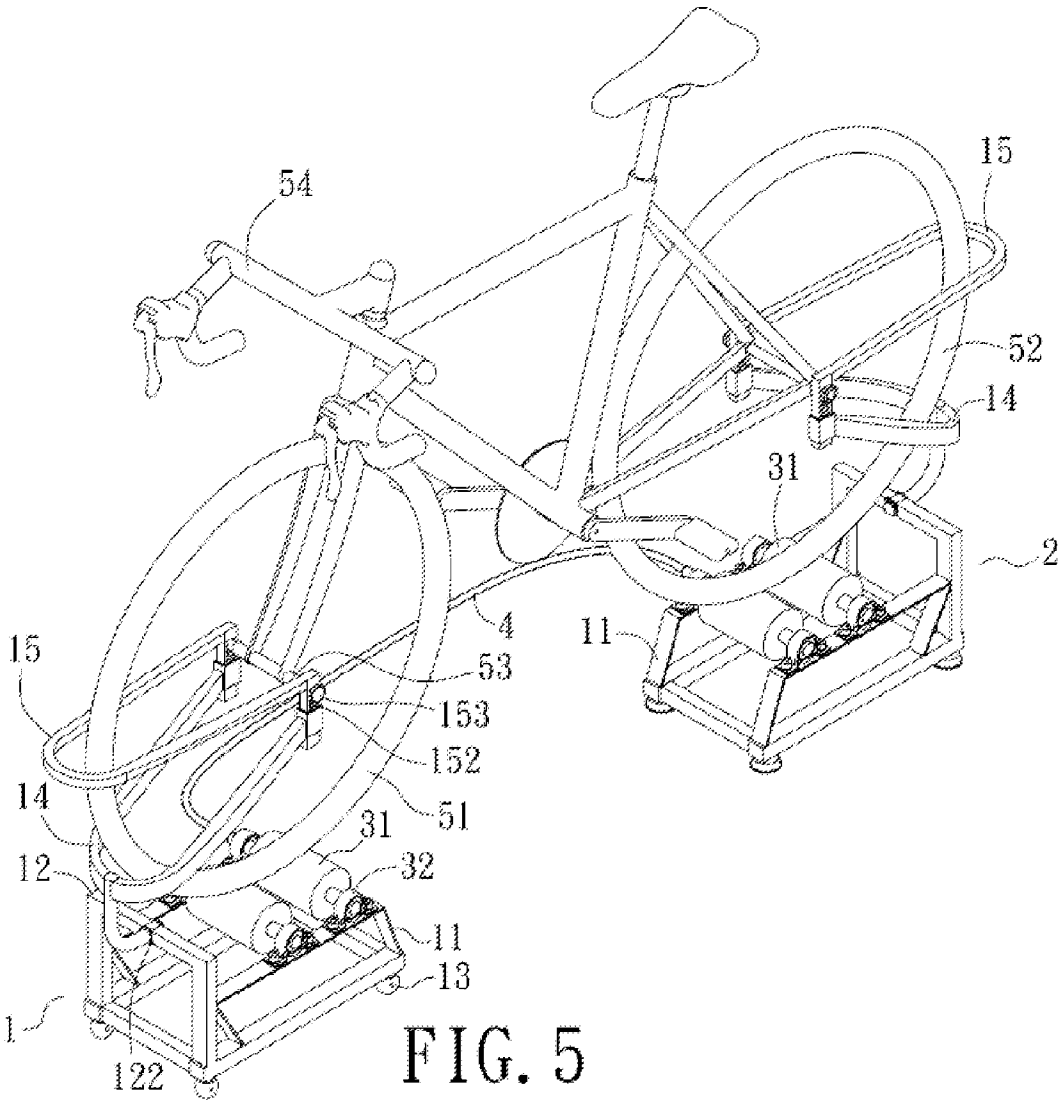
FIG. 5 is a perspective view to show a bicycle is supported by the support mechanism of the present invention.

Referring to FIGS. 3 to 5, the support mechanism of the present invention comprises a front unit 1 and a rear unit 2, the front wheel 51 of a bicycle is cooperated with the front unit 1 and the rear wheel 52 is cooperated with the rear unit 2. Each of the front and rear units 1, 2 includes two top rails 11 and each top rail 11 has multiple holes 111 defined therethrough. A U-shaped side rail 12 is connected between the two top rails 11 and includes a passage 121. The front unit 1 has multiple casters 13 connected to the underside thereof and multiple stationary members are connected to the underside of the rear unit 2.

Two U-shaped swing members 14 are respectively and pivotably connected to the front unit 1 and the rear unit 2 by inserting two curved extension into the passages 121 of the two side rails 12 of the front and rear units 1, 2. Bearings 122 are located between the curved extensions and the passages 121 so that the swing members 14 are pivoted about the curved extensions respectively. Two holes 141 are defined in two distal ends of each of the two swing members 14.

Two U-shaped positioning members 15 each have two insertions on two distal ends thereof and the insertions are respectively movably inserted into the connection holes 141 of the swing member 14 corresponding thereto. Each of the positioning members 15 includes a slot 151 and each slot 151 has a resilient members 152 received therein.

A roller set 3 includes multiple rollers 31 which are respectively connected to the front unit 1 and the rear unit 2. Each roller 31 includes two protrusions 311 extending from two ends thereof and each protrusion 311 is connected with a restriction member 32 which is fixed on the top rails 11 by bolts 33.

A connection unit 4 includes an outer tube 41, an inner tube 42 rotatably extending through the outer tube 41, and two connection ends 43. The two connection ends 43 are connected to two protrusions 311 of two respectively rollers 31 which are respectively located on the front unit 1 and the rear unit 2.

The bicycle is supported by the support mechanism 1 and the front wheel 51 and the rear wheel 52 are respectively supported on the rollers 31 on the front unit 1 and the rear unit 2. The front wheel shaft and the rear wheel shaft of the bicycle respectively extend through the slots 151 of the two positioning members 15. Two locking members 153 are inserted into the slots 151 of each of the two positioning members 15 and connected to the front wheel shaft and the rear wheel shaft. Each of the locking members 15 is located on a top end of the resilient member 152 corresponding thereto.

Figure 6:
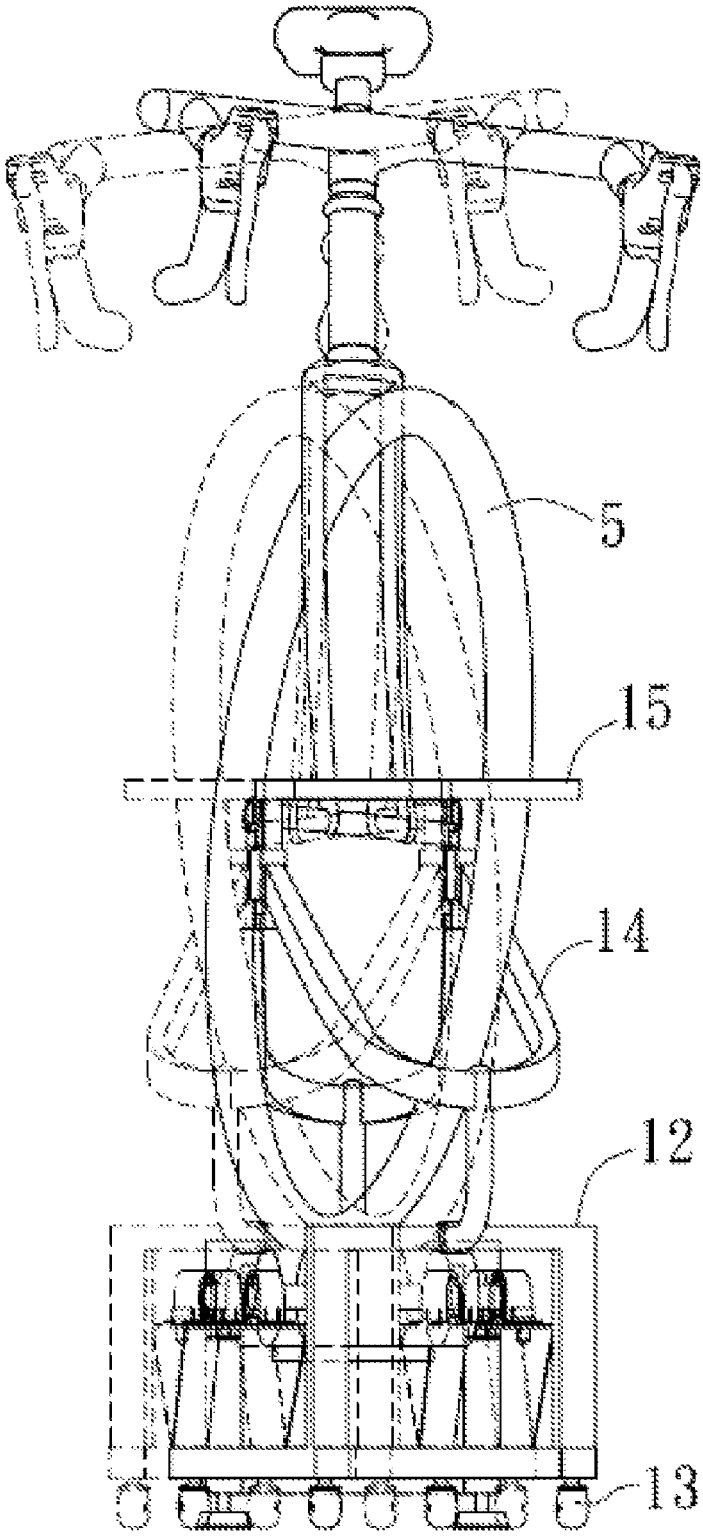
FIG. 6 shows that the bicycle support by the support mechanism of the present invention can be swung and the front wheel can be pivoted.

Further referring to FIG. 6, when the user treading the pedals of the bicycle, the rear wheel 52 is rotated and the rollers 31 on the rear unit 2 are rotated by the rear wheel 52. The rotation of the rollers 31 on the rear unit 2 drives the rollers 31 on the front unit 1 by the inner tube 42 of the connection unit 4, therefore, the front wheel 51 is rotated.

When the user swings his/her body, the bicycle swings and the front and rear wheels 51, 52 swings wherein the two swing members 14 are pivoted about the curved extensions thereof. When the user operates the handle 54 of the bicycle, the front unit 1 can be moved by the casters 13 so that the user has the same feel as riding a bicycle.

While we have shown and described the embodiment in accordance with the present invention, it should be clear to those skilled in the art that further embodiments may be made without departing from the scope of the present invention.

What is claimed is:

1. A support mechanism comprising:

a front unit and a rear unit adapted to securely support a bicycle with the front unit supporting the bicycle's front wheel and the rear unit supporting the bicycle's rear wheel;

two swing members respectively and pivotably connected to the front unit and the rear unit, the swing members being adapted to allow a bicycle supported thereon to swing from side to side;

two positioning members respectively connected to the two swing members;

a roller set including multiple rollers which are respectively connected to the front unit and the rear unit, each roller including a protrusion extending from each of two ends thereof, and a connection unit including an outer tube, an inner tube rotatably extending through the outer tube, and two connection ends, the two connection ends connected to two protrusions of two respectively rollers which are respectively located on the front unit and the rear unit such that rotation of a roller on the rear unit rotates a roller on the front unit.

2. The support mechanism as claimed in claim 1, wherein bearings are located between the swing members and the front and rear units to facilitate the pivoting motion of the swing members relative to the front and rear units.

3. The support mechanism as claimed in claim 1, wherein each of the swing members includes two connection holes and each of the positioning members is movably engaged with the connection holes.

4. The support mechanism as claimed in claim 3, wherein each of the positioning members includes two insertions and each insertion includes a slot, the insertions are inserted into the connection holes and two resilient members are located within the slots.

5. The support mechanism as claimed in claim 1, wherein the front unit includes casters connected to an underside thereof and the rear unit includes stationary members connected to an underside thereof.

6. The support mechanism as claimed in claim 4, wherein when a front wheel shaft and a rear wheel shaft of a bicycle respectively extend through the slots of the two positioning members, two locking members are inserted into the slots of each of the two positioning members and connected to the front wheel shaft and the rear wheel shaft, each of the locking members is located on a top end of the resilient member corresponding thereto.

* * * * *